US009978508B2

(12) United States Patent
Yan et al.

(10) Patent No.: US 9,978,508 B2
(45) Date of Patent: May 22, 2018

(54) HIGH CURRENT SWING-TYPE INDUCTOR AND METHODS OF FABRICATION

(71) Applicant: EATON INTELLIGENT POWER LIMITED, Dublin (IE)

(72) Inventors: Yipeng Yan, Shanghai (CN); Robert James Bogert, Lake Worth, FL (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 63 days.

(21) Appl. No.: 15/054,660

(22) Filed: Feb. 26, 2016

(65) Prior Publication Data

US 2016/0276087 A1 Sep. 22, 2016

Related U.S. Application Data

(63) Continuation of application No. PCT/CN2015/074550, filed on Mar. 19, 2015.

(51) Int. Cl.

| | |
|---|---|
| ***H01F 17/04*** | (2006.01) |
| ***H01F 27/28*** | (2006.01) |
| ***H01F 27/30*** | (2006.01) |
| ***H01F 27/29*** | (2006.01) |
| ***H01F 17/06*** | (2006.01) |

(52) U.S. Cl.

CPC ..... *H01F 27/292* (2013.01); *H01F 17/06* (2013.01); *H01F 27/2828* (2013.01); *H01F 27/306* (2013.01); *H01F 2017/065* (2013.01)

(58) Field of Classification Search

CPC ..... H01F 41/08; H01F 41/046; H01F 17/04; H01F 41/061

USPC ..... 336/221, 232, 208

See application file for complete search history.

(56) References Cited

U.S. PATENT DOCUMENTS

| | | | | |
|---|---|---|---|---|
| 5,500,629 | A * | 3/1996 | Meyer | H03H 7/0115 333/181 |
| 6,946,944 | B2 * | 9/2005 | Shafer | B29C 43/003 29/602.1 |
| 7,199,695 | B1 * | 4/2007 | Zhou | H01F 37/00 336/212 |
| 7,221,249 | B2 * | 5/2007 | Shafer | H01F 17/04 336/83 |
| 7,263,761 | B1 * | 9/2007 | Shafer | B29C 43/003 29/602.1 |
| 7,345,562 | B2 * | 3/2008 | Shafer | B29C 43/003 336/83 |
| 7,397,335 | B2 * | 7/2008 | Kawarai | H01F 17/0033 336/200 |
| 7,525,406 | B1 * | 4/2009 | Cheng | H01F 17/043 336/232 |
| 8,421,578 | B2 * | 4/2013 | Huang | H01F 3/14 336/212 |

(Continued)

OTHER PUBLICATIONS

Written Opinion of the International Searching Authority for International Application No. PCT/CN2015/074550, dated Mar. 19, 2015, 4 pages.

*Primary Examiner* — Alexander Talpalatski
*Assistant Examiner* — Joselito Baisa
(74) *Attorney, Agent, or Firm* — Armstrong Teasdale LLP

(57) ABSTRACT

A surface mount swing-type inductor component is configured to establish a non-uniform gap when assembled. The non-uniform gap produces swing-type inductor functionality in a compact package for higher current applications while being manufacturable at relatively low cost.

20 Claims, 13 Drawing Sheets

(56) References Cited

U.S. PATENT DOCUMENTS

| | | | | |
|---|---|---|---|---|
| 2008/0024259 | A1* | 1/2008 | Chandrasekaran | H01F 27/24 336/178 |
| 2008/0303624 | A1* | 12/2008 | Yamada | H01F 3/14 336/212 |
| 2010/0237973 | A1* | 9/2010 | Cheng | H01F 17/043 336/83 |
| 2015/0009004 | A1 | 1/2015 | Zhou et al. | |

* cited by examiner

HIGH CURRENT SWING-TYPE INDUCTOR AND METHODS OF FABRICATION

CROSS REFERENCE TO RELATED APPLICATIONS

This application is a continuation application of International Application No. PCT/CN2015/074550.

BACKGROUND OF THE INVENTION

The field of the invention relates generally to surface mount electromagnetic component assemblies and methods of manufacturing the same, and more specifically to surface mount, swing-type inductor components and methods of manufacturing the same.

Electromagnetic components such as inductors are known that utilize electric current and magnetic fields to provide a desired effect in an electrical circuit. Current flow through a conductor in the inductor component generates a magnetic field. The magnetic field can, in turn, be productively used to store energy in a magnetic core, release energy from the magnetic core, cancel undesirable signal components and noise in power lines and signal lines of electrical and electronic devices, or otherwise filter a signal to provide a desired output.

Swing-type inductor components, sometimes referred to as swinging chokes, are electromagnetic inductor components that may be utilized for example, in a filter circuit of a power supply that converts alternating current (AC) at a power supply input to direct current (DC) at a power supply output. Swinging chokes can also be used in filter circuitry associated with regulated, switching power supplies. Unlike other types of inductor components wherein the inductance of the component is generally fixed or constant despite the current load, the swinging choke has an inductance that varies with the current load.

More specifically, the swing-type inductor component may include a core that can be operated almost at magnetic saturation under certain current loads. The inductance of a swing core is at its maximum for a range of relatively small currents, and the inductance changes or swings to a lower value for another range of relatively higher currents. Certain challenges continue to exist in the construction and manufacture of swing-type inductor components. Improvements are desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
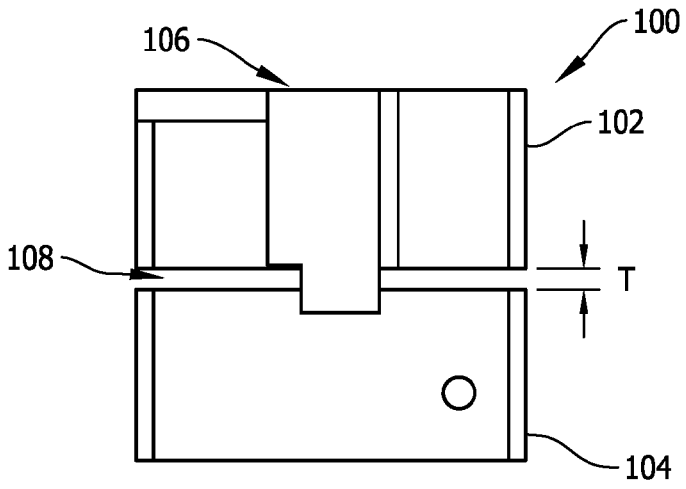
FIG. 1 is a side elevational view of a fixed inductance electromagnetic component assembly.

Exemplary embodiments of swing-type inductor components are described hereinbelow that may more capably preform in higher current, higher power circuitry than conventional inductor components now in use. The exemplary embodiments of swing-type power inductors are further manufacturable at relatively low cost and with simplified fabrication processes and techniques. Miniaturization of the exemplary embodiments of swing-type power inductors is also facilitated to provide surface mount inductor components with smaller package size, yet improved capabilities in high current applications. Method aspects will be in part apparent and in part explicitly discussed in the description below.

As mentioned above, swing-type inductor components are sometimes utilized in a filter circuit of a power supply that converts alternating current (AC) at a power supply input to direct current (DC) at a power supply output. Such converter circuitry may be commonly employed with or provided in combination with electronic devices of all kinds. In other applications, swing-type inductor components may be utilized in regulated, switching power supply circuitry of, for example, modern electronic devices of all kinds.

Recent trends to produce increasingly powerful, yet smaller electronic devices have led to numerous challenges to the electronics industry. Electronic devices such as smart phones, personal digital assistant (PDA) devices, entertainment devices, and portable computer devices, to name a few, are now widely owned and operated by a large, and growing, population of users. Such devices include an impressive, and rapidly expanding, array of features allowing such devices to interconnect with a plurality of communication networks, including but not limited to the Internet, as well as other electronic devices. Rapid information exchange using wireless communication platforms is possible using such devices, and such devices have become very convenient and popular to business and personal users alike.

For surface mount component manufacturers for circuit board applications required by such electronic devices, the challenge has been to provide increasingly miniaturized inductor components so as to minimize the area occupied on a circuit board by the inductor component (sometimes referred to as the component "footprint") and also its height measured in a direction perpendicular to a plane of the circuit board (sometimes referred to as the component "profile"). By decreasing the footprint and profile of inductor components, the size of the circuit board assemblies for electronic devices can be reduced and/or the component density on the circuit board(s) can be increased, which allows for reductions in size of the electronic device itself or increased capabilities of a device with comparable size. Miniaturizing electronic components in a cost effective manner has introduced a number of practical challenges to electronic component manufacturers in a highly competitive marketplace. Because of the high volume of inductor components needed for electronic devices in great demand, cost reduction in fabricating inductor components has been of great practical interest to electronic component manufacturers.

In order to meet increasing demand for electronic devices, especially hand held devices, each generation of electronic devices need to be not only smaller, but offer increased functional features and capabilities. As a result, the electronic devices must be increasingly powerful devices. For some types of components, such as electromagnetic inductor components that, among other things, may provide energy storage and regulation capabilities, meeting increased power demands while continuing to reduce the size of inductor components that are already quite small, has proven challenging.

As power density increases in regulated switching supply circuitry, higher operating frequency is required. Insofar as inductors are concerned, the higher operating frequency may reduce the inductance value for the same ripple current but also may increase switching loss significantly. Compared with full load operation, switching loss impacts overall efficiency more under light load as conduction loss is decreased. A lower switching frequency at lighter current load can, in turn, help reduce the switching loss but demands a higher open circuit inductance (OCL) to maintain the same current ripple as before. This is difficult to achieve, however, with conventional miniaturized inductor components.

FIG. 1 is a side elevational view of fixed inductance electromagnetic inductor component assembly 100 that is generally not capable of addressing the problem mentioned above. As shown in FIG. 1, the inductor 100 generally includes a first core piece 102, a second core piece 104, and a winding 106 that is configured for surface mount connection to a circuit board. As seen in FIG. 1, the winding 106 is positively engaged with both the first and second core pieces 102 and 104, and a uniform gap 108 having a constant thickness T extends between the facing surfaces of the first core piece 102 and the second core piece 104. The inductor component assembly 100 is advantageously manufacturable on a miniaturized level and can be manufactured in a relatively simply and low cost manner in relation to conventional inductor components.

Figure 2:
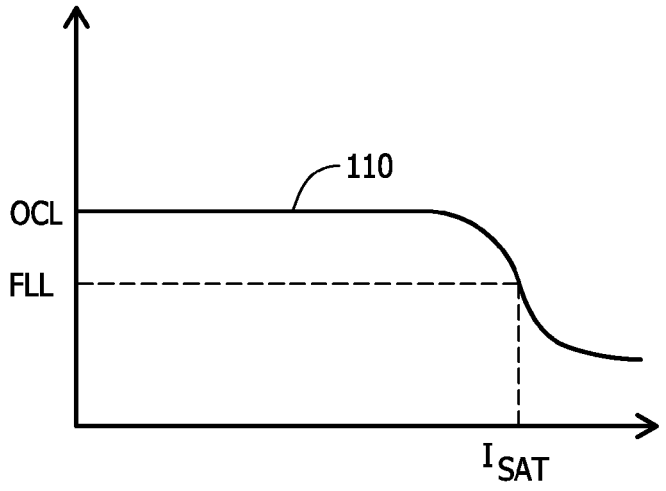
FIG. 2 is an inductance plot for the component assembly shown in FIG. 1.

FIG. 2 illustrates inductance characteristics of the inductor component assembly 100 in the form of an inductance plot wherein inductance values correspond to the vertical axis and wherein current corresponds to the horizontal axis. As seen in the inductance plot of FIG. 2, the inductor component assembly 100 exhibits a fixed and generally constant inductance value indicated in FIG. 2 by the horizontally plotted line 110 representing a constant open circuit inductance (OCL) value over a normal operating range of current values. That is, the open circuit inductance (OCL) value is the same regardless of the actual current load in use within the normal operating range of the inductor component assembly 100.

As also seen in the dashed lines in FIG. 2, when the inductor component assembly 100 is operated at a current up to its saturation current (Isat) that represents a full load inductance (FLL) or full load operation, the inductor component assembly 100 exhibits a fixed and generally constant inductance value corresponding to a full load inductance (FLL) value results regardless of the actual current load. While the inductor component assembly 100 can be operated at a lower switching frequency at a lighter current load to address switching loss in higher power density circuitry, because the OCL value of the inductor 100 is fixed the inductor component assembly 100 cannot maintain the same current ripple as when operated under a full load. This is only possible if the inductor component assembly 100 can operate at a higher OCL value, but as seen in FIG. 2 it cannot.

Exemplary embodiments of inductor component assemblies are therefore described below that are operable as swing-type inductors. That is, the embodiments described next are operable to achieve a higher OCL at light load and a lower OCL at full load, while still facilitating a miniaturized manufacture at relatively low cost. This is achieved at least in part by varying the gap characteristics between the core pieces in the inductor component assemblies as described below. Different formations of gaps, as well as different combinations of gap filler materials, may be provided to improve operating efficiency of inductor component assemblies at various different loads while maintaining a substantially constant ripple current.

Figure 3:
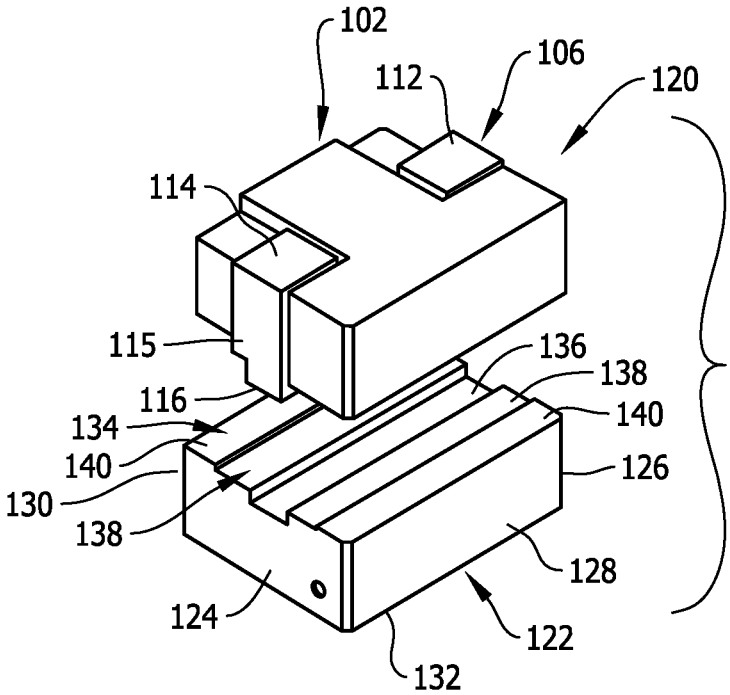
FIG. 3 is a partial exploded view of a magnetic component assembly formed in accordance with a first exemplary embodiment of the present invention.
Figure 4:
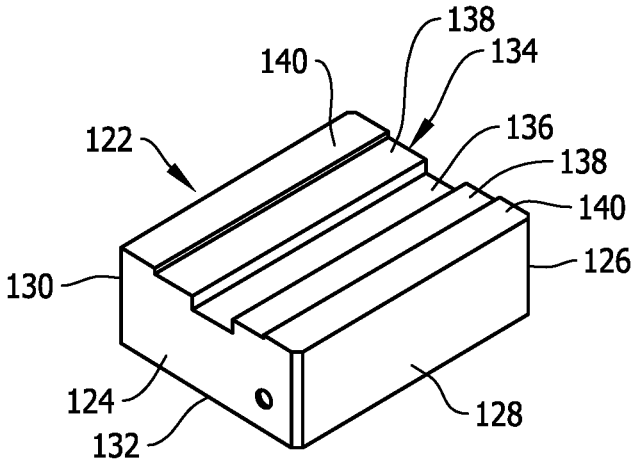
FIG. 4 is a perspective view of a first exemplary core piece utilized in the magnetic component assembly shown in FIG. 3.
Figure 5:
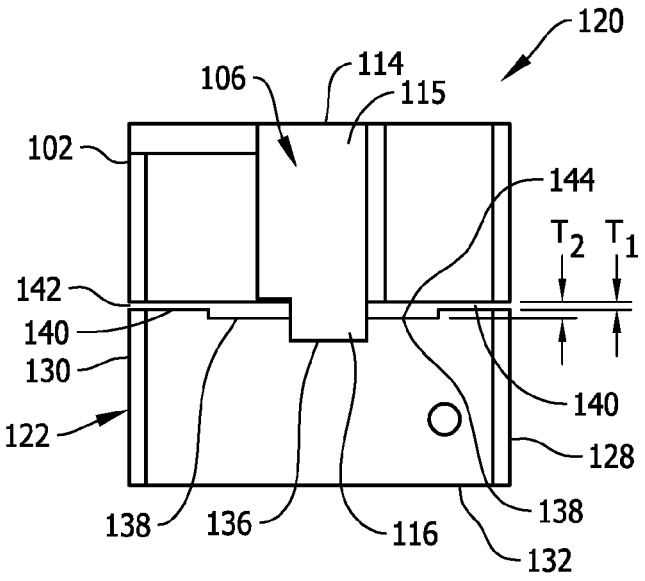
FIG. 5 is a side elevational view of the electromagnetic component assembly shown in FIG. 3.

FIGS. 3 through 5 are various views of a swing-type inductor component assembly 120 according to a first exemplary embodiment of the present invention.

FIG. 3 is a partial exploded view of the swing-type inductor component assembly 120 and is generally shown to include the first core piece 102, and the winding 106 as in the inductor component assembly 100 shown in FIG. 1.

The winding 106 in contemplated embodiments such as those shown may include a preformed C-shaped winding clip including surface mount terminal sections 112, 114 extending on a first surface, sometimes referred to as a bottom surface, of the core piece 102. The preformed C-shaped winding clip 106 may further include and a flat and planar, linearly extending main winding section 116 that engages an opposing surface, sometimes referred to herein as the top surface, of the core piece 102. The preformed C-shaped winding clip 106 may further include lateral side sections 115 extending between the main winding section 116 and each respective surface mount terminal section 112, 114. The preformed winding clip 106 may be fabricated in a known manner from an electrically conductive material such as copper in contemplated examples, and is formed or shaped into the configuration using known techniques prior to its assembly with the core piece 102.

For example, the preformed winding clip 106 may be fabricated from a planar strip of conductive material that is formed into the C-shape as shown and described. That is, starting from a planar strip of material of an appropriate length, the lateral side sections 215 may be bent to extend perpendicularly from the main winding section 116, and the surface mount terminal sections 112, 114 may be bent to extend perpendicularly from the lateral side sections 115. After being so formed and shaped, the clip 106 is provided for assembly with the core piece 102. Optionally, and as shown in the Figures, the main winding section 116 of the preformed clip 106, and also a portion of the lateral side sections 115 of the preformed clip 106 has a reduced width relative to the remainder of the preformed clip 106. As seen in side profile in FIGS. 3 and 5, the lateral side sections 115 of the preformed clip 106 include a right angle corner notch wherein the reduced width of the clip 106 begins and continues throughout the main winding section 116.

As shown in FIG. 3, the core piece 102 is configured for sliding assembly with the preformed winding clip 106 in a similar manner to that described in U.S. patent application Ser. No. 14/217,705. Because of its shape, the core piece 102 is sometimes referred to as an I core. One end of the core piece 102 is shaped to receive the preformed clip 106 as shown, and once the preformed clip 106 is received, it may be slid along the surfaces of the core piece 102 until it can be moved no further. The combination of the core piece 102 and the preformed clip 106 defines a first sub-assembly that may then be assembled with the core piece 122.

The assembly of the core piece 102 and the preformed winding clip 106 facilitates miniaturization of the component 120 at least in part because the surface mount terminal sections 112, 114 in the winding clip 106 are shaped in advance and do not need to be bent or otherwise formed on the surface of the core piece 102. The core piece 102 may accordingly be made smaller without risk of cracking during assembly that may otherwise occur when non-preformed windings are used that require the surface mount terminal sections to be bent around the surfaces of the core piece in order to be formed.

Unlike the inductor component assembly 100 shown in FIG. 1 including the second core piece 104, the swing-type inductor component assembly 120 includes the second core piece 122 that is configured to provide the swing-type inductor functionality. As best seen in FIG. 4, the core piece 122 in the example shown is generally rectangular and includes opposing lateral sides 124, 126 and opposing longitudinal sides 128, 130 interconnecting the lateral sides 124, 126. The longitudinal sides 128, 130 are longer than the lateral sides 124, 126 such that the core piece 122 has an elongated rectangular shape.

The core piece 122 also includes a first major flat side or surface 132 that extends between the lateral sides 124, 126 and longitudinal sides 128, 130. Opposite the first major flat side or surface 132 the core piece 122 includes a second, contoured side or surface 134 that extends between the lateral sides 124, 126 and longitudinal sides 128, 130. The contoured surface 134, when assembled with the core piece 102 and the winding 106, provides a non-uniform gap as described further that effects swing-type inductance characteristics.

More specifically, the contoured surface 134 of the core piece 122 generally includes a winding clip channel or slot 136 that extends parallel to the longitudinal sides 128, 130 and perpendicular to the lateral sides 124, 126. As best seen in FIG. 5, the winding clip channel or slot 136 in the example shown is slightly off-centered in the lateral direction to accommodate the reduced width portion of the main winding section 116 of the preformed winding clip 106. As such, the winding channel or slot 136 is a bit closer to the longitudinal side 128 than to the longitudinal side 130. In other embodiments wherein the preformed winding clip 106 has a uniform width throughout, the winding clip channel or slot 136 may be centered between the longitudinal sides 128 and 130 of the core piece 122. As such, in some embodiments the reduced width portion of the preformed winding clip 106 may be considered optional and need not be included. In further contemplated embodiments, in embodiments wherein the preformed winding clip 106 has a uniform width throughout, the winding clip channel or slot 136 need not necessarily be centered between the longitudinal sides 128 and 130 of the core piece 122.

Also in the example shown, the winding clip channel or slot 136 fully extends for the entire longitudinal length of the core piece 122 (i.e., for the entire length of the longitudinal sides 128, 130) between the lateral side walls 124, 126. That is the winding clip channel or slot 136 extends to and forms a portion of each of the lateral side walls 124, 126 of the core piece 122. The winding clip channel or slot 136 is formed as a U-shaped channel having a width and depth that receives the main winding section 116 as shown in FIG. 5 when the component is assembled. In contemplated embodiments, the depth of the winding clip channel or slot 136 may be less than thickness of the main winding section 116 of the preformed winding clip 106, such that when a first major side of the main winding section 116 is received in the clip channel or slot 136, the opposing major side of the main winding section 116 may extend partially above the clip channel or slot 136. By virtue of the winding clip channel or slot 136, the core piece 122 when viewed from the lateral sides 124, 126 resembles a U-shape in overall appearance and the core piece 122 is accordingly sometimes referred to a U core.

As also shown in FIG. 4, the contoured surface 134 of the core piece 122 includes, in addition to the winding clip channel or slot 136, a longitudinally extending recessed gap surface 138 extending adjacent to the winding clip channel or slot 136 and on either lateral side of the winding clip channel or slot 136. That is, a pair of opposing longitudinally extending recessed gap surfaces 138 is formed on opposing sides of the winding clip channel or slot 136 in the core piece 122.

The contoured surface 134 of the core piece 122 also includes, in addition to the longitudinally extending recessed gap surfaces 138, an longitudinally extending elevated gap surface 140 longitudinally extending adjacent to and on either lateral side of the longitudinally extending recessed gap surfaces 138. That is, a pair of longitudinally extending elevated gap surfaces 140 is formed on opposing sides of the longitudinally extending recessed gap surfaces 138.

In the example shown, the recessed gap surfaces 138 and the elevated gap surfaces 140 extend fully along the entire longitudinal length of the core piece 122 (i.e., for the entire length of the longitudinal sides 128, 130) and between the lateral sides 124, 126 of the core piece 122. The recessed gap surfaces 138 has a depth, relative to the elevated gap surfaces 140, that is less than the depth of the winding clip channel or slot 136 relative to the recessed gap surfaces 138, and the elevated gap surface 140 extends at the same height as the longitudinal side walls 128, 130. As such, in lateral side profile as shown in FIG. 5, the elevated gap surfaces 140 extend adjacent each respective longitudinal side 128, 130 at a first height or elevation measured in a direction perpendicular to the flat surface 132 of the core piece 122, the recessed gap surface 138 extends between the elevated gap surface 140 at a second height that is less than the first height, and the winding clip channel or slot 136 extends within the recessed gap surface 138 at a third height that is less than the second height. The contoured surface 134 is accordingly stepped to include three levels of surfaces. The elevated gap surface 140 extends at a first elevation level, the recessed surface 138 extends at a second elevation level different from and lower than the first elevation level, and the winding clip channel or slot 136 extends at a third elevation level that is less than the second elevation level. Alternatively stated, in the embodiment shown, a bottom of the winding clip channel or slot 136 extends in a first plane, the recessed gap surfaces 138 extend in a coplanar relationship in a second plane spaced from but parallel to the first plane, and the elevated gap surfaces 140 extend in a coplanar relationship in a third plane spaced from but parallel to the second plane and opposing the first plane.

Also, in the example shown, the elevated gap surfaces 140 extend for a first lateral distance (measured perpendicularly to the longitudinal sides 128, 130 and parallel to the lateral sides 124, 126), while the recessed gap surface 138 extends for a second lateral distance that is greater than the first distance. As best seen in FIG. 5, the respective lateral distances for elevated gap surface 140 and the recessed gap surface 138 on each lateral side of the main winding section 116 is not the same. This is because of the asymmetry of the preformed winding clip 106 that is caused by the reduced width of the main winding section 116. To accommodate the asymmetry of the preformed winding clip 106, an asymmetry results in the contoured surface 134 of the core piece 122 to accommodate the reduced width main winding section 116 when the component 120 is assembled.

Finally, the transition from each elevated gap surface 140 to each recessed gap surface 138, and also the transition from each recessed gap 138 to the winding clip channel or slot 136 are formed as generally right angle transitions. As such in the view of FIG. 5, the core piece 122 is formed with vertical (i.e., perpendicular) surfaces extending between the horizontally extending elevated gap surfaces 140 and the recessed gap surfaces 138 and also between the recessed gap surfaces 138 and the bottom wall of the winding clip channel or slot 136. In other embodiments, non-right angle transitions are possible, including but not limited to rounded corner transitions and sloped or inclined surfaces.

The core piece 122 including the contoured surface 134 described may be formed from a variety of magnetic materials using known techniques and processes. For example, the core piece 122 may be compression molded from granular magnetic powder materials into the shape as shown and described. Other fabrication techniques are possible, however, in further and/or alternative embodiments. In the example shown in FIGS. 2-5, the contoured surface 134 is integrally formed with or built-in to the construction of the core piece 122.

Unlike the inductor component assembly 100 (FIG. 1), when the second core piece 122 is assembled with the first core piece 102 and the preformed winding clip 106 as shown in FIG. 5, a non-uniform gap results between the first core piece 102 and the second core piece 122 via the contoured surface 134 that faces a flat top surface of the core piece 102. Specifically, a first gap portion 142 extends between the elevated gap surfaces 140 and the core piece 102 and the second gap portion 144 extends between the recessed gap surfaces 138 and the core piece 102. The first gap portion 142 has a first gap thickness $T_1$ and the second gap 144 portion has a second gap thickness $T_2$ that is greater than $T_1$.

The second gap portion 144 extends proximate the winding section 116 of the preformed winding 106 and extends generally parallel to a longitudinal axis defining an axial length of the main winding section 116. The first gap 142 extends alongside the second gap portion 144 on either side thereof. As such the first gap portion 142 extends to and proximate the longitudinal side walls 128, 130 and also extends generally parallel to a longitudinal axis of the main winding section 116. This orientation of gap portions 142, 144 that are defined by the recessed gap surfaces 138 and the elevated gap surfaces 140 and therefore extend parallel to the main winding section 116 of the preformed winding clip 106 is sometimes referred as a parallel gap configuration.

The first and second gap portions 142, 144 are further in fluid communication with one another to form a continuous gap including the first and second gap portions 142, 144. In the embodiment illustrated in FIG. 5, both gap portions 142, 144 are air gaps. In other embodiments, the gap portion 142 and/or 144 could be filled with a magnetic or non-magnetic material to provide further performance attributes and inductance values.

Figure 6:
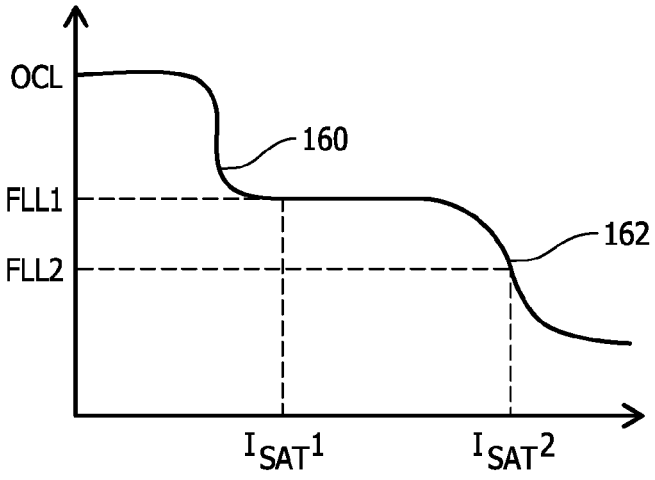
FIG. 6 is an exemplary inductance plot for the component assembly shown in FIGS. 3 and 5.

FIG. 6 is an exemplary inductance plot for the inductor component assembly 120. The OCL value is seen to include a first sharp drop shown at 160 and a second drop shown at 162, whereas the inductance plot shown in FIG. 2 for the inductor component assembly 100 includes a single drop. The first and second OCL drops 160 and 162 allow the component 120 to operate at a first current shown in FIG. 6 as $I_{Sat}$1 with corresponding full load inductance FLL1 while also facilitating operation at a second and higher current shown as $I_{Sat}$2 with corresponding full load inductance FLL2. The full load inductance FLL2 is seen to be lower than the full load inductance FLL1.

The inductor component assembly 120 is therefore operable at a lower current with a higher inductance value (e.g., FLL1), and a higher current level with a lower inductance value (e.g., FLL2). The inductor assembly 120 further exhibits a first OCL level in a first operating range and a second OCL level in a second operating range, rendering it possible to maintain constant current ripple current. As such, via the contoured surface 134 of the core piece 122 and the non-uniform gap that it establishes as described above, the inductor component assembly 120 is configured as a swing-type inductor component assembly, whereas the component assembly 100 that includes a uniform gap operates as a fixed inductance component. The inductor component assembly 120 therefore is operable with enhanced performance relative to the component 100 while still facilitating miniaturization and manufacturing benefits. Specifically, the inductor assembly 120 can be operated efficiently at a lower switching frequency at a lighter current load to address switching loss in higher density circuitry, without affecting the ripple current.

Figure 7:
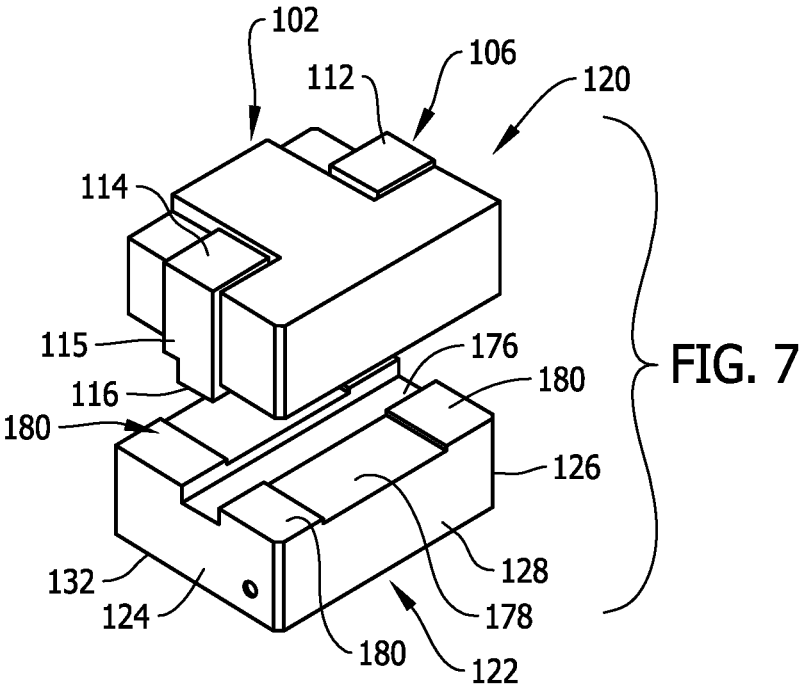
FIG. 7 is a partial exploded view of a magnetic component assembly formed in accordance with a second exemplary embodiment of the present invention.
Figure 8:
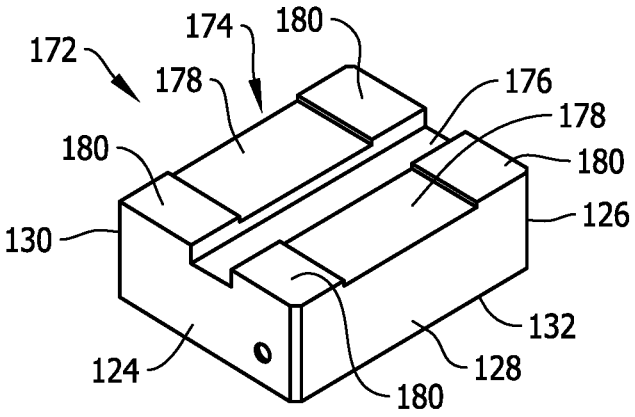
FIG. 8 is a perspective view of a second exemplary core piece utilized in the magnetic component assembly shown in FIG. 7.
Figure 9:
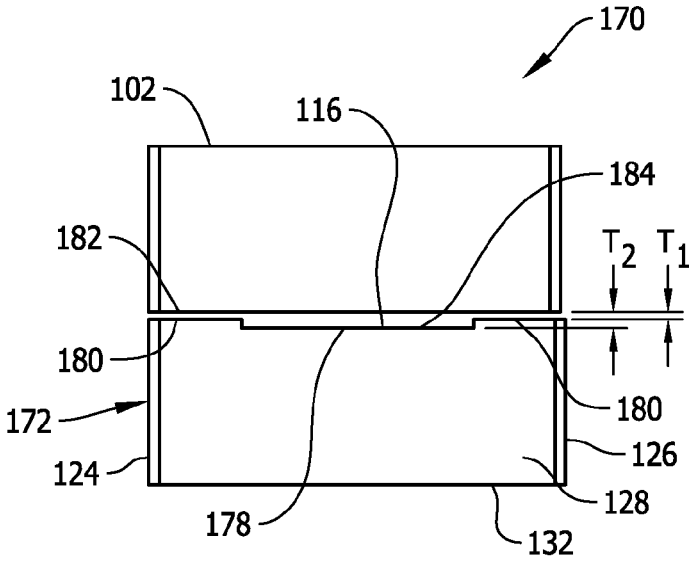
FIG. 9 is a side elevational view of the electromagnetic component assembly shown in FIG. 7.

FIGS. 7-9 illustrate another exemplary swing-type inductor component assembly 170 according to a second exemplary embodiment of the present invention.

The component assembly 170 includes the core piece 102 and preformed winding clip 106 as described above. Unlike the component assembly 100 shown in FIG. 1 including the second core piece 104, the swing-type inductor component assembly 170 includes a second core piece 172 that is configured to provide the swing-type inductor functionality. Like the core piece 122, and as best seen in FIG. 8, the core piece 172 in the example shown is generally rectangular and includes opposing lateral sides 124, 126 and opposing longitudinal sides 128, 130 interconnecting the lateral sides 124, 126. The longitudinal sides 128, 130 are longer than the lateral sides 124, 126 such that the core piece 122 has an elongated rectangular shape.

The core piece 172 also includes a first major flat side or surface 132 that extends between the lateral sides 124, 126 and longitudinal sides 128, 130. Opposite the first major flat side or surface 132 the core piece 122 includes a second, contoured side or surface 174 that extends between the lateral sides 124, 126 and longitudinal sides 128, 130. The contoured surface 174 provides a non-uniform gap as described further below when the core piece 172 is assembled with the first core piece 102 and the preformed winding clip 106.

More specifically, the contoured surface 174 of the core piece 172 generally includes a winding clip channel or slot 176 that extends parallel to the longitudinal sides 130, 132 and perpendicular to the lateral sides 124, 126. The winding clip channel or slot 176 in the example shown is off-centered to accommodate a reduced width of the main winding section 116 of the preformed winding clip 106. As such, the winding channel or slot 176 is a bit closer to the longitudinal side 128 than to the longitudinal side 130. In other embodiments wherein the preformed winding clip 106 has a uniform width throughout, the winding clip channel or slot 176 may be centered between the longitudinal sides 128 and 130.

Also in the example shown, the winding clip channel or slot 176 fully extends for the entire longitudinal length of the core piece 172 (i.e., for the entire length of the longitudinal sides 128, 130) and has a width and depth that receives the main winding section 116 as shown in FIG. 9. As described above, the depth of the winding clip channel or slot 176 may be selected such that the main winding section 116 protrudes from the winding clip channel or slot 176 when the component 170 is assembled. By virtue of the winding clip channel or slot 176, the core piece 172 when viewed from the lateral sides 124, 126 resembles a U-shape and the core piece 172 is accordingly sometimes referred to a U core.

As also shown in FIG. 8, the contoured surface 174 of the core piece 172 further includes recessed gap surfaces 178 extending from and between the winding clip channel or slot 176 and each longitudinal side in the lateral direction (i.e., a direction parallel to the lateral sides 124, 126) in a longitudinal center portion of the contoured surface 174.

The contoured surface 174 of the core piece 172 further includes elevated gap surfaces 180 extending from and between the winding clip channel or slot 176 and each longitudinal side in the lateral direction (i.e., a direction parallel to the lateral sides 124, 126) in first portions of the contoured surface 174 adjacent each lateral side 124, 126 of the core piece 172.

The recessed gap surfaces 178 and the elevated gap surfaces 180 extend partially or incompletely along the longitudinal length of the core piece 172 (i.e., for less than the entire length of the longitudinal sides 128, 130). The elevated gap surfaces 180 respectively extend adjacent each lateral side 124, 126 for a first longitudinal distance, and the recessed gap surfaces 178 respectively extend between the elevated gap surfaces 140 for a second longitudinal distance. As shown in FIGS. 7 and 8, the elevated gap surfaces 180 extend at the four corners of the contoured surface 174, while the recessed gap surfaces 178 extend between the elevated gap surfaces 180 in a longitudinal direction. Meanwhile, the winding clip or channel 176 separates the elevated gap surface 180 and the recessed gap surface 178 in a lateral direction.

The recessed gap surface 178 has a depth that is less than the depth of the winding clip channel or slot 176, and the elevated gap surface 180 extends at the same height as the longitudinal side walls 128, 130. As such, in longitudinal side profile as shown in FIG. 9, the elevated gap surface 180 extends adjacent each respective lateral side 124, 126 at a first height measured in a direction perpendicular to the flat surface 132 of the core piece 172 and the recessed gap surface 178 extends at a second height that is less than the first height. As seen in FIGS. 7 and 8, the winding clip channel or slot 176 extends within the elevated gap surface 180 and also within the recessed gap surface 178 at a third height that is less than the second height. The contoured surface 174 is stepped to include multiple levels of surfaces in spaced apart but parallel planes. The surfaces 180 extend in a coplanar relationship at a first elevation, the surfaces 178 extend in a coplanar relationship at a second elevation different from and lower than the first elevation, and the winding channel or slot 176 extends at a third elevation that is less than the second elevation.

Unlike the core piece 122 where the elevated and recessed gap surfaces 140, 138 are arranged side-by-side in a longitudinal direction, the elevated and recessed gap surfaces 180, 178 are arranged side-by-side in a lateral direction. That is, the arrangement of elevated and recessed gap surfaces 180, 178 in the core piece 172 is oriented generally perpendicular to the arrangement of elevated and recessed gap surfaces 140, 138 in the core piece 122. In other words, while the gap surfaces 138, 140 in the core piece 122 extend parallel to the main winding section 116 when in the clip winding channel or slot 136, in the core piece 172 the elevated and recessed gap surfaces 178, 180 in the core piece 172 extend perpendicular to the main winding section 116. The configuration of the elevated and recessed gap surfaces 178, 180 in the core piece 172 is sometimes referred to as a perpendicular gap configuration because the elevated and recessed gap surfaces 178, 180 extend transversely or perpendicularly to the main winding section 116 and the winding clip channel or slot 176.

Finally, the transition from the elevated gap surfaces 180 to the recessed gap surfaces 178, and also the transitions from the elevated and recessed gap surfaces 178, 180 to the winding clip channel or slot 176 are each generally right angle transitions including perpendicular surfaces (i.e., vertical surfaces in the views of FIGS. 8 and 9) extending between the horizontally extending elevated and recessed gap surfaces 178, 180 and the horizontally extending bottom wall of the clip channel or slot 176. In other embodiments, non-right angle transitions are possible, including but not limited to rounded corner transitions and sloped or inclined surfaces.

The core piece 172 including the contoured surface 174 described may be formed from a variety of magnetic materials using known techniques and processes. For example, the core piece 172 may be compression molded from granular magnetic powder materials into the shape as shown and described. Other fabrication techniques are, however, possible. In the example shown in FIGS. 7-10, the contoured surface 174 is integrally formed with or built-in to the construction of the core piece 122.

Unlike the first component assembly 100 (FIG. 1), when the second core piece 172 is assembled with the first core piece 102 and the preformed winding clip 106 as shown in FIG. 9, a non-uniform gap results between the first core piece 102 and the second core piece 172 via the contoured surface 174 that faces a flat top surface of the core piece 102. Specifically, a first gap portion 182 extends between the gap surface 180 and the core piece 102 having a first gap thickness $T_1$ and a second gap portion 184 extends between the gap surface 178 and the core piece 102 having a second gap thickness $T_2$ that is larger than $T_1$. In the example shown in FIG. 9, the gap portions 182, 184 are in fluid communication with one another and are air gaps. In other embodiments, the gap portions 182 and/or 184 could be filled with magnetic and non-magnetic materials to provide different performance characteristics and inductance values.

Figure 10:
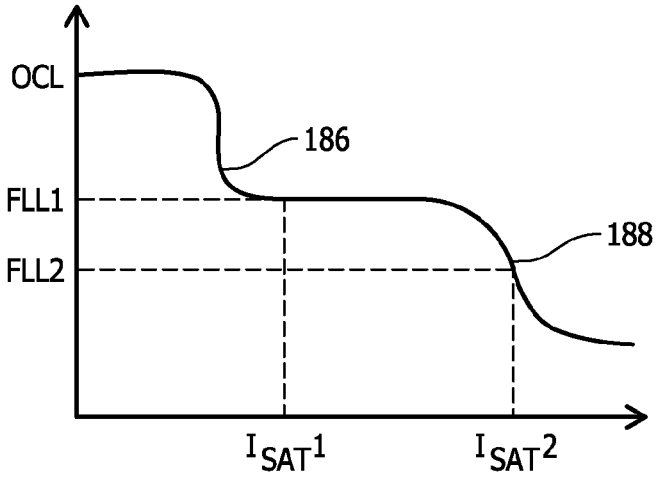
FIG. 10 is an exemplary inductance plot for the component assembly shown in FIG. 9.

FIG. 10 is an exemplary inductance plot for the inductor component assembly 170. The OCL value is seen to include a first sharp drop shown at 186 and a second drop shown at 188, whereas the inductance plot shown in FIG. 2 for the inductor component assembly 100 includes a single drop. The first and second OCL drops 186 and 188 allow the component 170 to operate at a first current shown as $I_{Sat}$1 with corresponding full load inductance FLL1 while also facilitating operation at a second and higher current shown as $I_{Sat}$2 with corresponding full load inductance FLL2. The full load inductance FLL2 is seen to be lower than the full load inductance FLL1. The swinging choke functionality demonstrated in the inductance plot shown in FIG. 10 resembles the inductance plot of FIG. 6 for the component assembly 120 and provides according similar benefits and advantages. The actual values represented by the plots of FIG. 10 and FIG. 6 are different, however, in view of the different configuration of the core piece 170 versus the core piece and the associated differences in configuration of the non-uniform gaps established. As such, the inductor component assembly 170 may offer different performance than the inductor component assembly 120 that may in some cases be advantageous over the performance attributes of the inductor component assembly 170.

Figure 11:
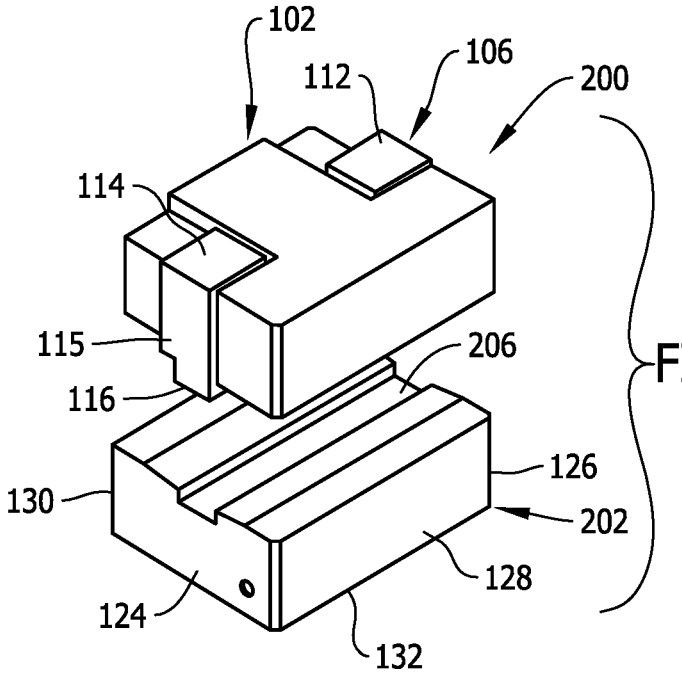
FIG. 11 is a partial exploded view of a magnetic component assembly formed in accordance with a third exemplary embodiment of the present invention.
Figure 12:
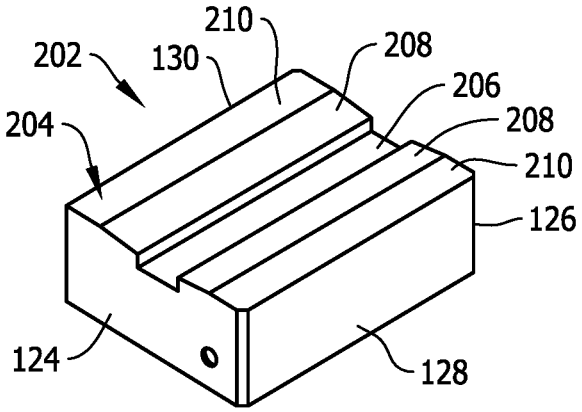
FIG. 12 is a perspective view of a third exemplary core piece utilized in the magnetic component assembly shown in FIG. 11.
Figure 13:
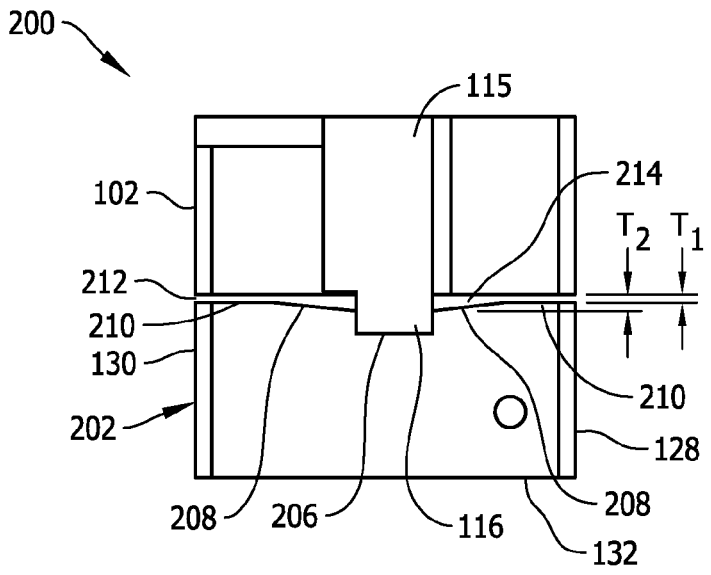
FIG. 13 is a side elevational view of the electromagnetic component assembly shown in FIG. 11.

FIGS. 11-13 illustrate another exemplary swing-type inductor component assembly 200 according to a third exemplary embodiment of the present invention.

The component assembly 200 includes the core piece 102 and preformed winding clip 106 as described above. Unlike the component assembly 100 shown in FIG. 1 including the second core piece 104, the swing-type inductor component assembly 200 includes a second core piece 202 that is configured to provide the swing-type inductor functionality. Like the core piece 122 (FIGS. 3-5), and as best seen in FIG. 12, the core piece 200 in the example shown is generally rectangular and includes opposing lateral sides 124, 126 and opposing longitudinal sides 128, 130 interconnecting the lateral sides 124, 126. The longitudinal sides 128, 130 are longer than the lateral sides 124, 126 such that the core piece 202 has an elongated rectangular shape.

The core piece 202 also includes a first major flat side or surface 132 that extends between the lateral sides 124, 126 and longitudinal sides 128, 130. Opposite the first major flat side or surface 132 the core piece 202 includes a second, contoured side or surface 204 that extends between the lateral sides 124, 126 and longitudinal sides 128, 130. The contoured surface 204 provides a non-uniform gap as described further below when the core piece 202 is assembled with the first core piece 102 and the preformed winding clip 106.

More specifically, the contoured surface 204 of the core piece 202 generally includes a winding clip channel or slot 206 that extends parallel to the longitudinal sides 130, 132 and perpendicular to the lateral sides 124, 126. The winding clip channel or slot 206 in the example shown is off-centered to accommodate a reduced width of the main winding section 116 of the preformed winding clip 106. As such, the winding channel or slot 206 is a bit closer to the longitudinal side 128 than to the longitudinal side 130. In other embodiments wherein the preformed winding clip 106 has a uniform width throughout, the winding clip channel or slot 206 may be centered between the longitudinal sides 128 and 130, Also in the example shown, the winding clip channel or slot 206 fully extends for the entire longitudinal length of the core piece 202 (i.e., for the entire length of the longitudinal sides 128, 130) and has a width and depth that receives the main winding section 116 of the preformed clip as shown in FIG. 13. By virtue of the winding clip channel or slot 206, the core piece 202 when viewed from the lateral sides 124, 126 resembles a U-shape and the core piece 202 is accordingly sometimes referred to a U core.

As also shown in FIG. 12, the contoured surface 204 of the core piece 202 further includes recessed gap surfaces 208 extending on either lateral side of the winding clip channel or slot 206, and elevated gap surfaces 210 extending on either lateral side of the recessed gap surfaces 208. The recessed gap surface 208 and the elevated gap surface 210 also extend fully along the entire longitudinal length of the core piece 202 (i.e., for the entire length of the longitudinal sides 128, 130). The elevated and recessed gap surfaces 210, 208 extend parallel to the winding clip channel or slot 206 in the longitudinal direction.

Unlike the previous embodiments, the recessed gap surfaces 208 are defined by sloped surfaces extending between the elevated gap surface 210 and the winding clip channel or slot 206. The elevated gap surfaces 140 extend at the same height as the longitudinal side walls 128, 130 and the recessed gap surfaces 208 extend as inclined and respectively oppositely sloped surfaces from the elevated gap surfaces 140 to the winding clip channel or slot 206. As such, in lateral side profile as shown in FIG. 13, the elevated gap surfaces 210 extends adjacent each respective longitudinal side 128, 130 in a coplanar relationship at a first height measured in a direction perpendicular to the flat surface 132 of the core piece 202, and each of the recessed gap surfaces 208 slope downwardly from the elevated gap surface 210 toward the sides of the winding clip channel or slot 206. Alternatively stated, a first one of the recessed gap surfaces 208 has a positive slope on one side of the winding clip channel or slot 206 and a second one of the recessed gap surfaces 208 has a negative slope (but otherwise equal value to the positive slope) on the opposing side of the winding clip channel or slot 206. As such, at any particular point along the recessed gap surfaces 208 in a lateral direction (i.e., a direction parallel to the lateral sides 124 and 126), a different depth is realized by virtue of the sloped surfaces.

The contoured surface 204 is therefore stepped and includes two levels of planar surfaces. The elevated surfaces 210 extend in a coplanar relationship at a first elevation and the bottom of the winding clip channel or slot 206 extends at a second elevation different from and lower than the first elevation. The elevated gap surfaces 210 and winding clip channel or slot 206 extend in spaced apart, parallel planes while the recessed gap surface 208 transitions between the surface 210 and the clip channel 206.

Also, in the example shown, the elevated gap surfaces 210 extend for a first lateral distance (measured perpendicular to the longitudinal sides 128, 130 and parallel to the lateral sides 124, 126), while the recessed gap surface 208 extends for a second lateral distance that is greater than the first distance. As best seen in FIG. 13, the respective lateral distances for elevated gap surface 210 and the recessed gap surface 208 on each lateral side of the main winding section 116 is not the same. This is because of the asymmetry of the preformed winding clip 106 as discussed above, which creates an asymmetry in the contoured surface 204 of the core piece 202 to accommodate the reduced width main winding section 116 of the preformed winding clip 106.

The core piece 202 including the contoured surface 204 described may be formed from a variety of magnetic materials using known techniques and processes. For example, the core piece 202 may be compression molded from granular magnetic powder materials into the shape as shown and described. Other fabrication techniques are, however, possible. In the example shown in FIGS. 11-13, the contoured surface 174 is integrally formed with or built-in to the construction of the core piece 122.

Unlike the first component assembly 100 (FIG. 1), when the second core piece 202 is assembled with the first core piece 102 and the preformed winding clip 106 as shown in FIG. 13, a non-uniform gap results between the first core piece 102 and the second core piece 202 via the contoured surface 204 that faces a flat top surface of the core piece 102. Specifically, a first gap portion 212 extends between the gap surface 210 and the core piece 102 having a first gap thickness $T_1$. A second gap portion 214 extends between the recessed gap surface 208 and the core piece 102 that has a non-uniform or variable thickness by virtue of the sloped recessed gap surfaces 208 with maximum dimension $T_2$. As seen in FIG. 13, the first gap portion thickness $T_1$ is less than the second gap thickness $T_2$ except where the surfaces 208, 210 meet. The second gap portion 214 extends proximate the winding section 116, while the first gap portion 212 extends proximate the longitudinal side walls 128, 130. This orientation of gap portions 210, 214 that are defined by the recessed gap surfaces 208 and the elevated gap surfaces 210 and therefore extend parallel to the main winding section 116 of the preformed winding clip 106 is sometimes referred as a parallel gap configuration.

Figure 14:
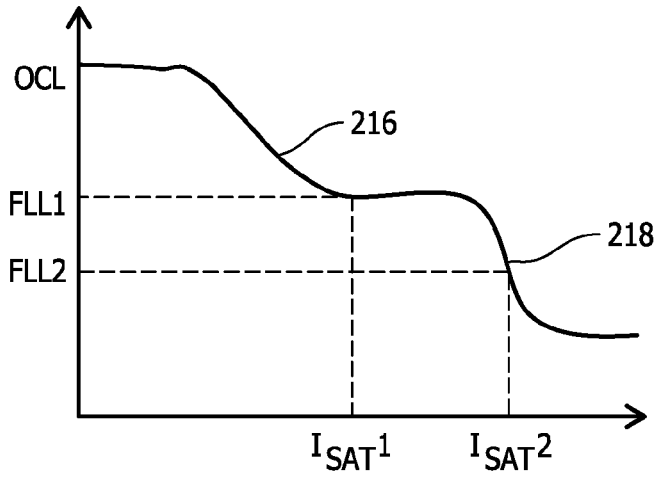
FIG. 14 is an exemplary inductance plot for the component assembly shown in FIG. 13.
Figure 15:
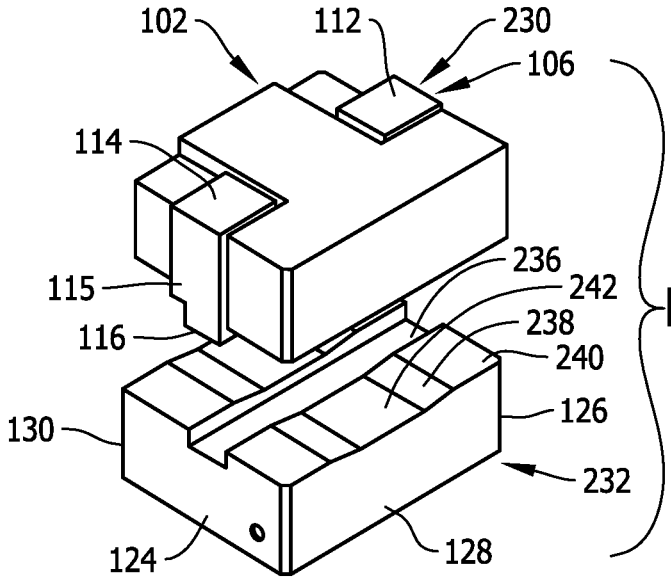
FIG. 15 is a partial exploded view of a magnetic component assembly formed in accordance with a fourth exemplary embodiment of the present invention.

FIG. 14 is an exemplary inductance plot for the component assembly 200. Unlike the components 120 and 170 described above, the OCL value is seen to include a first soft drop shown at 216 and a second hard drop shown at 218, whereas the inductance plot shown in FIG. 2 for the inductor component assembly 100 includes a single drop. Thus, like the inductor component assemblies 120 and 170, the inductor component assembly advantageously offers swing-type choke functionality and similar benefits to those described above. As evident from the inductance plot of FIG. 13, the inductor component assembly 170 may offer different performance than the either of the inductor component assemblies 120 and 170 that may in some cases be advantageous over the performance attributes of the component assemblies 120 or 170 in specific applications.

FIGS. 15-18 illustrate another exemplary swing-type inductor component assembly 230 according to a fourth exemplary embodiment of the present invention.

Figure 16:
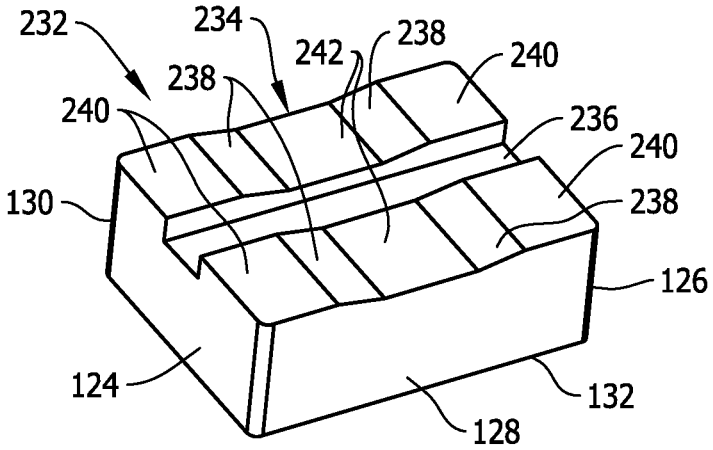
FIG. 16 is a perspective view of a fourth exemplary core piece utilized in the magnetic component assembly shown in FIG. 15.

The component assembly 230 includes the core piece 102 and preformed winding clip 106 as described above. Unlike the component assembly 100 shown in FIG. 1 including the second core piece 104, the swing-type inductor component assembly 230 includes a second core piece 232 that is configured to provide the swing-type inductor functionality. Like the core piece 172 (FIGS. 7-9), and as best seen in FIG. 16, the core piece 230 in the example shown is generally rectangular and includes opposing lateral sides 124, 126 and opposing longitudinal sides 128, 130 interconnecting the lateral sides 124, 126. The longitudinal sides 128, 130 are longer than the lateral sides 124, 126 such that the core piece 232 has an elongated rectangular shape.

The core piece 232 also includes a first major flat side or surface 132 that extends between the lateral sides 124, 126 and longitudinal sides 128, 130. Opposite the first major flat side or surface 132 the core piece 232 includes a second, contoured side or surface 234 that extends between the lateral sides 124, 126 and longitudinal sides 128, 130. The contoured surface 234 provides a non-uniform gap as described further below when the core piece 232 is assembled with the first core piece 102 and the preformed winding clip 106.

Figure 17:
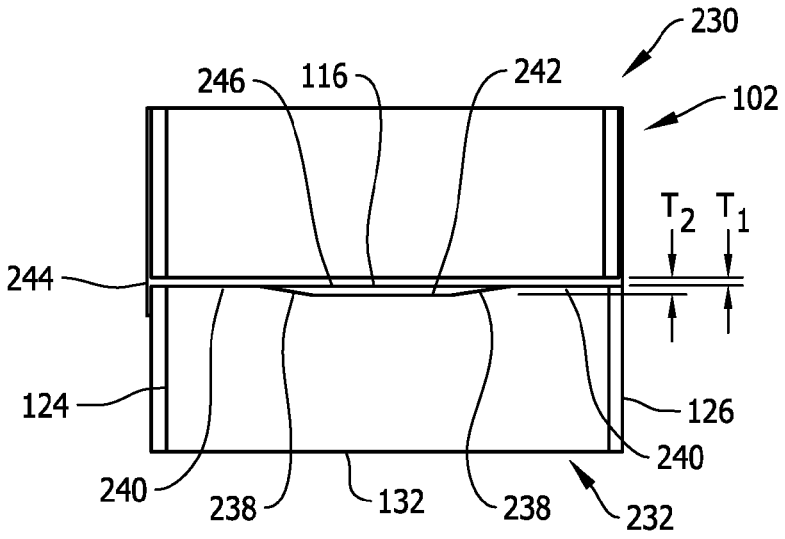
FIG. 17 is a side elevational view of the electromagnetic component assembly shown in FIG. 15.

More specifically, the contoured surface 234 of the core piece 232 generally includes a winding clip channel or slot 236 that extends parallel to the longitudinal sides 130, 132 and perpendicular to the lateral sides 124, 126. The winding clip channel or slot 236 in the example shown is off-centered to accommodate a reduced width of the main winding section 116 of the preformed winding clip 106. As such, the winding channel or slot 236 is a bit closer to the longitudinal side 128 than to the longitudinal side 130. In other embodiments wherein the preformed winding clip 106 has a uniform width throughout, the winding clip channel or slot 236 may be centered between the longitudinal sides 128 and 130, Also in the example shown, the winding clip channel or slot 236 fully extends for the entire longitudinal length of the core piece 232 (i.e., for the entire length of the longitudinal sides 128, 130) and has a width and depth that receives the main winding section 116 of the preformed clip as shown in FIG. 17. By virtue of the winding clip channel or slot 236, the core piece 232 when viewed from the lateral sides 124, 126 resembles a U-shape and the core piece 232 is accordingly sometimes referred to a U core.

As also shown in FIG. 16, the contoured surface 234 of the core piece 202 further includes recessed gap surfaces 238 extending on either lateral side of the winding clip channel or slot 236, and elevated gap surfaces 240 extending on either lateral side of the recessed gap surfaces 238. The recessed gap surfaces 238 and the elevated gap surface 240 extend incompletely along the entire longitudinal length of the core piece 232 (i.e., for less than the entire length of the longitudinal sides 128, 130). The elevated and recessed gap surfaces 240, 238 extend perpendicular to axis of the winding clip channel or slot 236 in the longitudinal direction.

The recessed gap surfaces 238 are defined by sloped surfaces extending between the elevated gap surface 240 and the winding clip channel or slot 236. The elevated gap surfaces 240 extends at the same height as the longitudinal side walls 128, 130 and the recessed gap surfaces 238 extend as inclined and respectively oppositely sloped surfaces from the elevated gap surfaces 240 to a central recessed gap surface 242 extending parallel to but spaced from the elevated gap surface 240. As such, in longitudinal side profile as shown in FIG. 17, the elevated gap surfaces 240 extends adjacent each respective lateral side 124, 133 in a coplanar relationship at a first height measured in a direction perpendicular to the flat surface 132 of the core piece 232, each of the recessed gap surfaces 238 slope downwardly from the elevated gap surface 240 toward recessed gap surface 242. Alternatively stated, a first one of the recessed gap surfaces 238 has a positive slope on one side of the recessed gap surface 242 and a second one of the recessed gap surfaces 238 has a negative slope (but otherwise equal value to the positive slope) on the opposing side of the recessed gap surface 242. As such, at any particular point along the recessed gap surfaces 238 in a longitudinal direction (i.e., a direction perpendicular to the lateral sides 124 and 126, a different depth is realized by virtue of the sloped gap surfaces 238.

The contoured surface 234 is therefore stepped and includes two levels of planar surfaces. The elevated surfaces 240 extend in a coplanar relationship at a first elevation and the recessed gap surface 242 extends at a second elevation different from and lower than the first elevation. The elevated gap surfaces 240 and the recessed gap surface 242 extend in spaced apart, parallel planes while the recessed gap surface 238 transitions between the surface 240 and the recessed gap surface 242.

Also, in the example shown, the elevated gap surfaces 240 extend for a first longitudinal distance (measured parallel to the longitudinal sides 128, 130 and perpendicular to the lateral sides 124, 126), while the recessed gap surfaces 138 extends for a second longitudinal distance that is less than the first distance, while the recessed surface 242 extends for a third longitudinal distance that is greater than the first distance.

The core piece 232 including the contoured surface 234 described may be formed from a variety of magnetic materials using known techniques and processes. For example, the core piece 232 may be compression molded from granular magnetic powder materials into the shape as shown and described. Other fabrication techniques are, however, possible. In the example shown in FIGS. 15-18, the contoured surface 234 is integrally formed with or built-in to the construction of the core piece 132.

Unlike the first component assembly 100 (FIG. 1), when the second core piece 232 is assembled with the first core piece 102 and the preformed winding clip 106 as shown in FIG. 13, a non-uniform gap results between the first core piece 102 and the second core piece 232 via the contoured surface 234 that faces a flat top surface of the core piece 102. Specifically, a first gap portion 244 extends between the gap surface 240 and the core piece 102 having a first gap thickness $T_1$. A second gap portion 246 extends between the recessed gap surface 242 that has a uniform thickness dimension $T_2$ that is greater than first gap thickness $T_1$. On either opposed end of the gap portion 246 the gap portion has a non-uniform or variable thickness by virtue of the sloped recessed gap surfaces 238 with maximum dimension $T_2$ and minimum dimension $T_1$.

As seen in FIG. 17, the first gap portion thickness $T_1$ is less than the second gap thickness $T_2$ except where the surfaces 238, 242 meet. The second gap portion 214 extends proximate the winding section 116, while the first gap portion 244 extends proximate the lateral side walls 124, 126. This orientation of gap portions 244, 246 that are defined by the recessed gap surfaces 238, 242 and the elevated gap surfaces 210 and therefore extend perpendicular to the main winding section 116 of the preformed winding clip 106 is sometimes referred as a perpendicular or transverse gap configuration.

Figure 18:
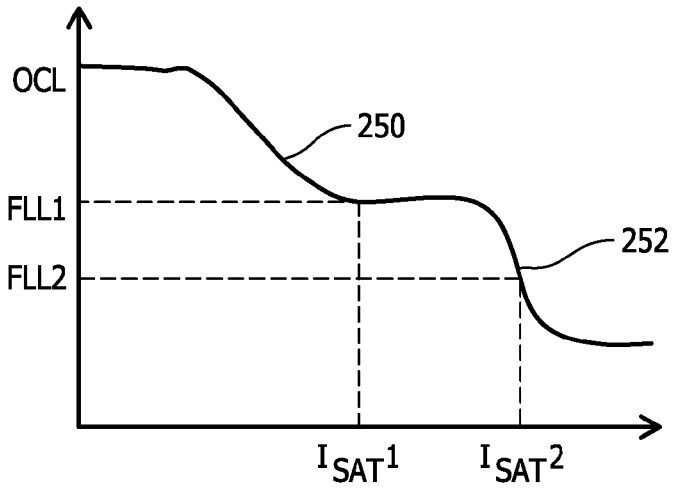
FIG. 18 is an exemplary inductance plot for the component assembly shown in FIG. 17.
Figure 19:
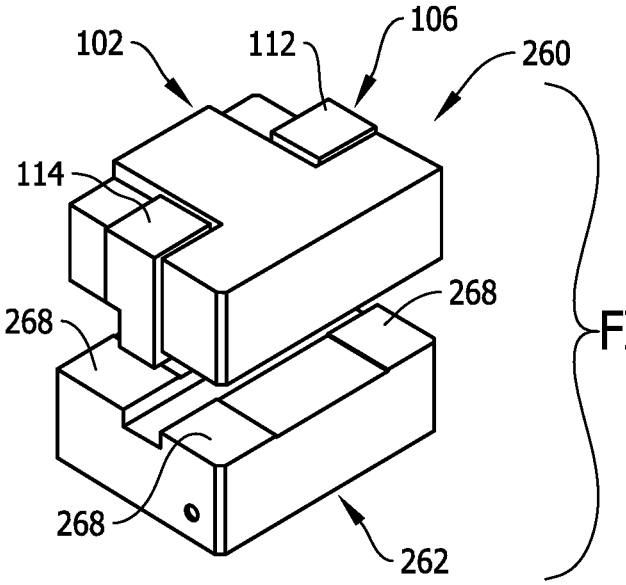
FIG. 19 is a partial exploded view of a magnetic component assembly formed in accordance with a fifth exemplary embodiment of the present invention.

FIG. 18 is an exemplary inductance plot for the component assembly 230. Unlike the components 120 and 170 described above, the OCL value is seen to include a first soft drop shown at 250 and a second hard drop shown at 252, whereas the inductance plot shown in FIG. 2 for the inductor component assembly 100 includes a single drop. Thus, like the inductor component assemblies 120 and 170, the inductor component assembly advantageously offers swing-type choke functionality and similar benefits to those described above. As evident from the inductance plot of FIG. 18, the inductor component assembly 230 may offer different performance than the either of the inductor component assemblies 120 and 170 that may in some cases be advantageous over the performance attributes of the component assemblies 120 or 170 in specific applications.

FIGS. 19-22 illustrate another exemplary swing-type inductor component assembly 260 according to a fifth exemplary embodiment of the present invention.

Figure 20:
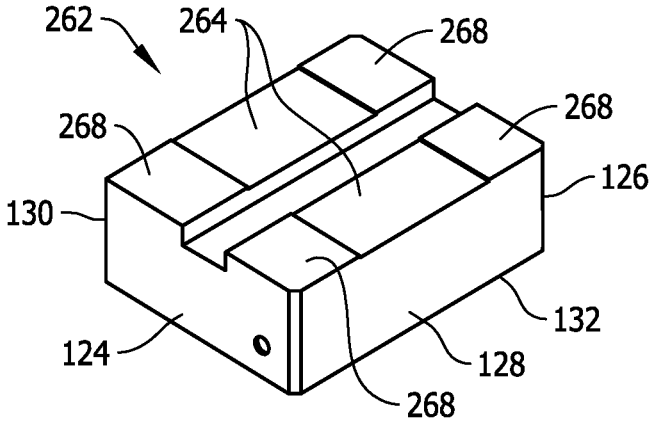
FIG. 20 is a perspective view of a fifth exemplary core piece utilized in the magnetic component assembly shown in FIG. 19.
Figure 21:
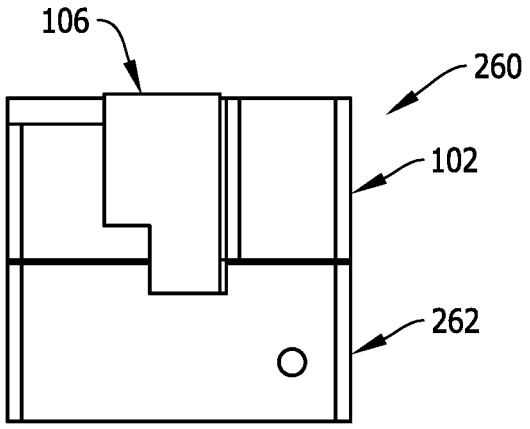
FIG. 21 is a side elevational view of the electromagnetic component assembly shown in FIG. 19.
Figure 22:
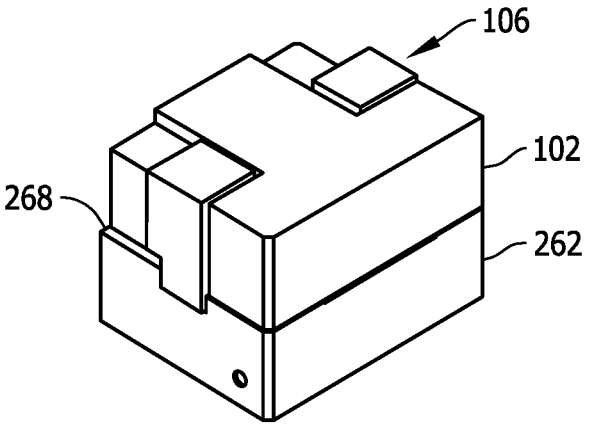
FIG. 22 is a side elevational view of the electromagnetic component assembly shown in FIG. 19.
Figure 23:
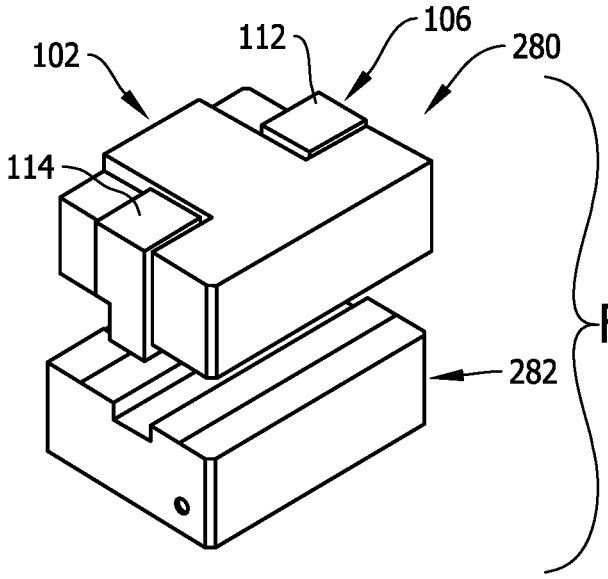
FIG. 23 is a partial exploded view of a magnetic component assembly formed in accordance with a sixth exemplary embodiment of the present invention.

The component assembly 260 includes the core piece 102 and preformed winding clip 106 as described above. Unlike the component assembly 100 shown in FIG. 1 including the second core piece 104, the swing-type inductor component assembly 230 includes a second core piece 262 that is configured to provide the swing-type inductor functionality. As best seen in FIG. 20, the core piece 262 in the example shown is generally rectangular and includes opposing lateral sides 124, 126 and opposing longitudinal sides 128, 130 interconnecting the lateral sides 124, 126. The longitudinal sides 128, 130 are longer than the lateral sides 124, 126 such that the core piece 232 has an elongated rectangular shape.

The core piece 262 also includes a first major flat side or surface 132 that extends between the lateral sides 124, 126 and longitudinal sides 128, 130. Unlike the core pieces described above, opposite the first major flat side or surface 132 the core piece 262 includes a second, major flat side or surface 264 that extends between the lateral sides 124, 126 and longitudinal sides 128, 130. That is, instead of the surface 264 being contoured to provide recessed and elevated gap surfaces, the surface 264 is a substantial flat and planar surface that is not contoured. Elevated gap surfaces 268 are, however built up on the surface 264 with a magnetic material, having the same or different properties, from the magnetic material utilized to form the core piece 262. Alternatively stated, in the previous embodiments the recessed and elevated gap surfaces are integrally formed or built-in to the core piece fabrication in a one-step manufacturing process, whereas in the component 260 the elevated gap surface 268 are formed in a second step after the main core piece 262 is formed.

The resultant non-uniform gap created in the component 260 is similar that described above in relation to the component 170 described above in relation to FIGS. 8-10, but because of the different magnetic material utilized to create the elevated gap surfaces 268 in the component 260 the inductance plot would be different than that shown in FIG. 10 for the component 170. The non-uniform gap established in the component 260 is partly magnetic in the areas where the second magnetic material resides in order to create the elevated gap surface 264 and is partly an air gap where the second magnetic material is not present, whereas in the component 170 the non-uniform gap is entirely an air gap.

Because the gap established is partly magnetic and partly non-magnetic, the gap is sometimes referred to as a hybrid gap.

The inductance plot of the component 260 can further be influenced if the magnetic material utilized has different magnetic properties than the main core piece 262.

FIGS. 23-26 illustrate another exemplary swing-type inductor component assembly 280 according to a sixth exemplary embodiment of the present invention.

Figure 24:
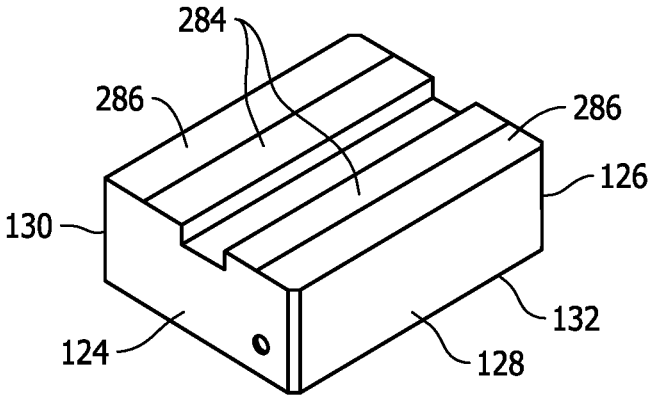
FIG. 24 is a perspective view of a sixth exemplary core piece utilized in the magnetic component assembly shown in FIG. 23.

The component assembly 280 includes the core piece 102 and preformed winding clip 106 as described above. Unlike the component assembly 100 shown in FIG. 1 including the second core piece 104, the swing-type inductor component assembly 280 includes a second core piece 282 that is configured to provide the swing-type inductor functionality. As best seen in FIG. 24, the core piece 282 in the example shown is generally rectangular and includes opposing lateral sides 124, 126 and opposing longitudinal sides 128, 130 interconnecting the lateral sides 124, 126. The longitudinal sides 128, 130 are longer than the lateral sides 124, 126 such that the core piece 282 has an elongated rectangular shape.

The core piece 282 also includes a first major flat side or surface 132 that extends between the lateral sides 124, 126 and longitudinal sides 128, 130. Opposite the first major flat side or surface 132 the core piece 282 includes a second, major flat side or surface 284 that extends between the lateral sides 124, 126 and longitudinal sides 128, 130. That is, instead of the surface 284 being contoured to provide recessed and elevated gap surfaces, the surface 284 is a substantial flat and planar surface that is not contoured. Elevated gap surfaces 286 are, however built up on the surface 284 with a magnetic material, having the same or different properties, from the magnetic material utilized to form the core piece 282. Alternatively stated, and unlike some of the previous embodiments the recessed and elevated gap surfaces are integrally formed or built-in to the core piece fabrication in a one-step manufacturing process, in the component 280 the elevated gap surface 286 is formed in a second step after the main core piece 282 is formed.

Figure 25:
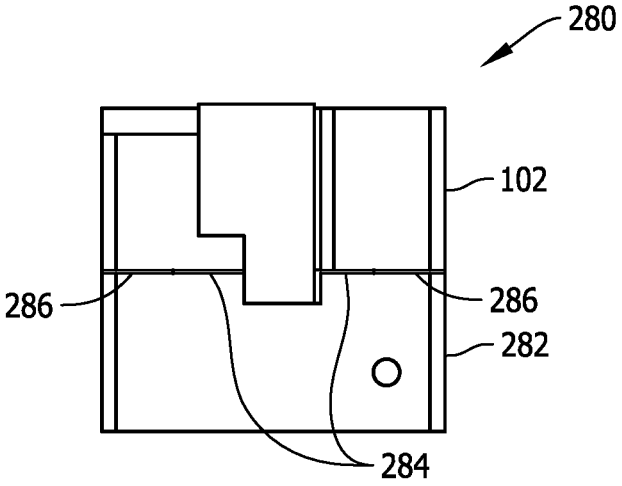
FIG. 25 is a side elevational view of the electromagnetic component assembly shown in FIG. 23.
Figure 26:
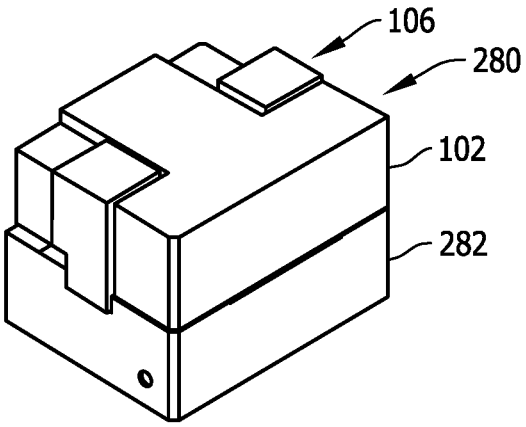
FIG. 26 is a side elevational view of the electromagnetic component assembly shown in FIG. 23.

The resultant non-uniform gap created in the component 280 is similar that described above in relation to the component 120 described above in relation to FIGS. 3-7, but because of the different magnetic material utilized to create the elevated gap surfaces 286 in the component 280 the inductance plot would be different than that shown in FIG. 6 for the component 120. As seen in FIG. 25, the non-uniform gap established in the component 280 is partly magnetic in the areas where the second magnetic material resides in order to create the elevated gap surface 286 and is partly an air gap where the second magnetic material is not present, whereas in the component 120 the non-uniform gap is entirely an air gap. Because the gap established is partly magnetic and partly non-magnetic, the gap is sometimes referred to as a hybrid gap.

The inductance plot of the component 280 can further be influenced if the magnetic material utilized has different magnetic properties than the main core piece 282.

In the component 280, the air gap seen in FIG. 25 could further be filled with a magnetic material having a lower Bsat characteristic to saturate earlier to create the first step OCL drop in the inductance plot. A similar modification could be made to the component 260 (FIGS. 19-22). As such, the non-uniform gap may be established with two different magnetic materials to provide further variation of inductance plots for the components constructed with swing-type functionality.

The various components described above offer a considerably variety of swing-type inductor functionality while using a small number of component parts that are manufacturable to provide small components at relatively low cost with superior performance advantages. In particular, the various components described utilize the same core piece 102 and the same winding 106 that may be combined with the various different core pieces 122, 172, 202, 232, 262 and 282 to provide a wide variety of swing-type inductors having different performance characteristics.

The benefits and advantages of the inventive concepts discloses are now believed to be evident in view of the exemplary embodiments disclosed.

An embodiment of an electromagnetic component assembly has been disclosed including: a first shaped magnetic core piece; a second shaped magnetic core piece; and a pre-fabricated conductive winding including a main winding section and first and second surface mount terminal sections, wherein the first shaped core piece is configured to slidably receive the pre-fabricated winding with the main winding section extended on a first side of the first shaped core piece and the surface mount terminal sections extending on a second side of the first shaped core piece opposite the first side; wherein the second shaped magnetic core piece defines a channel in which the main winding section is received and extended in the channel; and wherein the second shaped magnetic core piece includes a stepped surface adjacent the channel, the stepped surface configured to establish a non-uniform gap between the first shaped magnetic core piece and the second shaped magnetic core piece when the winding section is received and extended in the channel.

Optionally, the stepped surface may include a first step and a second step, the first step establishing a first portion of the non-uniform gap having a first thickness, and the second step may establish a second portion of the non-uniform gap having a second thickness different from the first thickness. The second shaped magnetic core piece may be formed with opposing longitudinal sides and opposing lateral sides interconnecting the longitudinal sides, and the channel may extend parallel to the longitudinal sides. The second shaped magnetic core piece may include at least one sloped wall extending between the first and second steps.

As further options, the second shaped magnetic core piece may be formed with opposing longitudinal sides and opposing lateral sides interconnecting the longitudinal sides, and the non-uniform gap may extend parallel to the longitudinal sides. Alternatively, the non-uniform gap may extend parallel to the lateral sides.

The non-uniform gap may be entirely an air gap. Alternatively, the non-uniform gap may be at least partly an air gap. The non-uniform gap may include at least a first gap portion having a first thickness and a second gap portion having a second thickness, with the first gap portion in fluid communication with the second gap portion. The non-uniform gap may be at least partly magnetic.

The second shaped magnetic core piece may include at least one built-up step. Alternatively, the stepped surface may be built-in to the second shaped magnetic core piece. The second shaped magnetic core pieces may include a rectangular side, and elevated gap surfaces extending adjacent the corners of the rectangular side. The non-uniform gap may have a first thickness proximate the channel and a second thickness proximate a periphery of the second shaped magnetic core piece, wherein the first thickness is greater than the second thickness.

As still further options, the non-uniform gap is partly magnetic and partly non-magnetic. The stepped surface may include at least one sloped surface. The at least one sloped surface may include a first sloped surface having a positive slope and a second sloped surface having a negative slope. The channel may extend between the first sloped surface and the second sloped surface. The non-uniform gap may have at least one gap portion of a variable thickness.

The winding section may partly protrudes from the channel when extended in the channel. The second shaped magnetic core piece may include opposing longitudinal side walls, and the channel may extend parallel to the opposed side walls. The non-uniform gap may extend parallel to the clip channel. The stepped surface may include a pair of elevated gap surfaces a pair of recessed gap surfaces. The second shaped magnetic core piece further comprising opposing lateral side walls, and wherein the at least one elevated gap surface and the at least one recessed gap surface extend completely between the lateral side walls. The second shaped magnetic core piece may include opposing lateral sides, and wherein the non-magnetic gap extends parallel to the opposing lateral sides.

The stepped surface may optionally include a pair of elevated gap surfaces a pair of recessed gap surfaces. The second shaped magnetic core piece may include opposing longitudinal side walls, and wherein the pair of elevated gap surfaces and the pair of recessed gap surfaces each extend incompletely between the longitudinal side walls. Each of the pair of elevated gap surfaces and the pair of recessed gap surfaces may extend adjacent and alongside the channel.

The pair of recessed gap surfaces extends adjacent and alongside the channel, and wherein the pair of elevated gap surfaces extends alongside the pair of recessed gap surfaces. The pair of recessed gap surfaces may separate the pair of elevated gap surfaces from the channel. The second shaped magnetic core piece may include opposing longitudinal side walls and wherein the pair of elevated gap surfaces extend completely alongside the longitudinal side walls. Sloped surfaces may extend between the pair of elevated gap surfaces and the pair of recessed gap surfaces. The pre-fabricated conductive winding may include a C-shaped winding clip. The C-shaped winding clip may be asymmetrical.

The channel may be off-centered in the second shaped magnetic core piece. The component may be a swing-type choke inductor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electromagnetic component assembly comprising:

a first shaped magnetic core piece;

a second shaped magnetic core piece differently shaped from the first magnetic core piece; and a pre-fabricated conductive winding including a main winding section and first and second surface mount terminal sections, wherein the first shaped magnetic core piece is configured to slidably receive the pre-fabricated winding with the main winding section extended on a first side of the first shaped core piece and the surface mount terminal sections extending on a second side of the first shaped core piece opposite the first side;

wherein the second shaped magnetic core piece defines a second side overlying the first side of the first shaped core piece, the second side including a channel in which the main winding section is received and extended in the channel; and wherein the second side of the second shaped magnetic core piece further includes a stepped surface adjacent the channel, the stepped surface configured to establish a non-uniform gap between the first side of the first shaped magnetic core piece and the second side of the second shaped magnetic core piece.

2. The electromagnetic component assembly of claim 1, wherein the stepped surface includes a first step and a second step, the first step establishing a first portion of the non-uniform gap having a first thickness, and the second step establishing a second portion of the non-uniform gap having a second thickness different from the first thickness.

3. The electromagnetic component assembly of claim 2, wherein the second shaped magnetic core piece is formed with opposing longitudinal sides and opposing lateral sides interconnecting the longitudinal sides, and wherein the channel extends parallel to the longitudinal sides.

4. The electromagnetic component assembly of claim 3, wherein the second shaped magnetic core piece comprises at least one sloped wall extending between the first and second steps.

5. The electromagnetic component assembly of claim 1, wherein the second shaped magnetic core piece is formed with opposing longitudinal sides and opposing lateral sides interconnecting the longitudinal sides, and wherein the non-uniform gap extends parallel to the longitudinal sides.

6. The electromagnetic component assembly of claim 1, wherein the second shaped magnetic core piece is formed with opposing longitudinal sides and opposing lateral sides interconnecting the longitudinal sides, and wherein the non-uniform gap extends parallel to the lateral sides.

7. The electromagnetic component assembly of claim 1, wherein the non-uniform gap is entirely an air gap.

8. The electromagnetic component assembly of claim 1, wherein the non-uniform gap includes at least a first gap portion having a first thickness and a second gap portion having a second thickness, the first gap portion in fluid communication with the second gap portion.

9. The electromagnetic component assembly of claim 1, wherein the non-uniform gap is at least partly magnetic.

10. The electromagnetic component assembly of claim 1, wherein the second shaped magnetic core piece includes at least one built-up step on the second side.

11. The electromagnetic component assembly of claim 1, wherein the stepped surface is built-in to the second shaped magnetic core piece.

12. The electromagnetic component assembly of claim 1, wherein the second shaped magnetic core piece includes a rectangular side, and elevated gap surfaces extending adjacent the corners of the rectangular side.

13. The electromagnetic component assembly of claim 1, wherein the non-uniform gap has a first thickness proximate the channel and a second thickness proximate a periphery of the second shaped magnetic core piece, wherein the first thickness is greater than the second thickness.

14. The electromagnetic component assembly of claim 1, wherein the non-uniform gap is partly magnetic and partly non-magnetic.

15. The electromagnetic component assembly of claim 1, wherein the stepped surface comprises a first sloped surface having a positive slope and a second sloped surface having a negative slope.

16. The electromagnetic component assembly of claim 15, wherein the channel extends between the first sloped surface and the second sloped surface.

17. The electromagnetic component assembly of claim 1, wherein the winding section partly protrudes from the channel when extended in the channel.

18. The electromagnetic component assembly of claim 1, wherein the pre-fabricated conductive winding comprises a C-shaped winding clip.

19. The electromagnetic component assembly of claim 1, wherein the channel is off-centered in the second shaped magnetic core piece.

20. The electromagnetic component assembly of claim 1, wherein the component is a swing-type choke inductor.

* * * * *